US005813455A

United States Patent [19]

Pratt et al.

[11] Patent Number: 5,813,455

[45] Date of Patent: Sep. 29, 1998

[54] CHEMICAL DISPENSING SYSTEM

[75] Inventors: Gary V. Pratt, Woodward; Ronald F. Sloan, Elk City, both of Okla.

[73] Assignee: Amoco Coporation, Chicago, Ill.

[21] Appl. No.: 814,379

[22] Filed: Mar. 11, 1997

[51] Int. Cl.[6] ..... E21B 33/068; E21B 43/00

[52] U.S. Cl. ..... 166/75.15; 166/310

[58] Field of Search ..... 166/75.11, 75.15, 166/310, 108, 70

[56] References Cited

U.S. PATENT DOCUMENTS

| | | | |
|---|---|---|---|
| 2,961,045 | 11/1960 | Stigman et al. | 166/75.15 |
| 3,403,729 | 10/1968 | Hickey | 166/75.15 |
| 4,033,408 | 7/1977 | Fredd et al. | 166/75.15 |
| 4,132,243 | 1/1979 | Kuus | 166/75.15 X |
| 4,785,880 | 11/1988 | Ashton | 166/53 |
| 4,944,347 | 7/1990 | Richard et al. | 166/278 |

*Primary Examiner*—Frank Tsay
*Attorney, Agent, or Firm*—Thomas A. Yassen; Robert E. Sloat

[57] ABSTRACT

An apparatus and method for automatically dispensing chemical sticks into a well bore is provided. In the preferred form, the apparatus is for dispensing soap sticks to unload an oil/gas producing well of fluid, e.g., salt water, built-up therein. The apparatus is a tubular receptacle with an upper storage section and a lower receiving chamber with sticks stacked end-to-end in the storage section and fed, as by gravity feed, to the receiving chamber after a stick is dispensed therefrom. An operating mechanism controls dispensing so that a stick is dispensed based on a predetermined timing sequence or when a predetermined well condition is reached. A preferred soap stick for use in the apparatus includes a water-soluble, flexible, resilient sheath encasing the stick body tightly therein.

23 Claims, 7 Drawing Sheets

Fig. 3
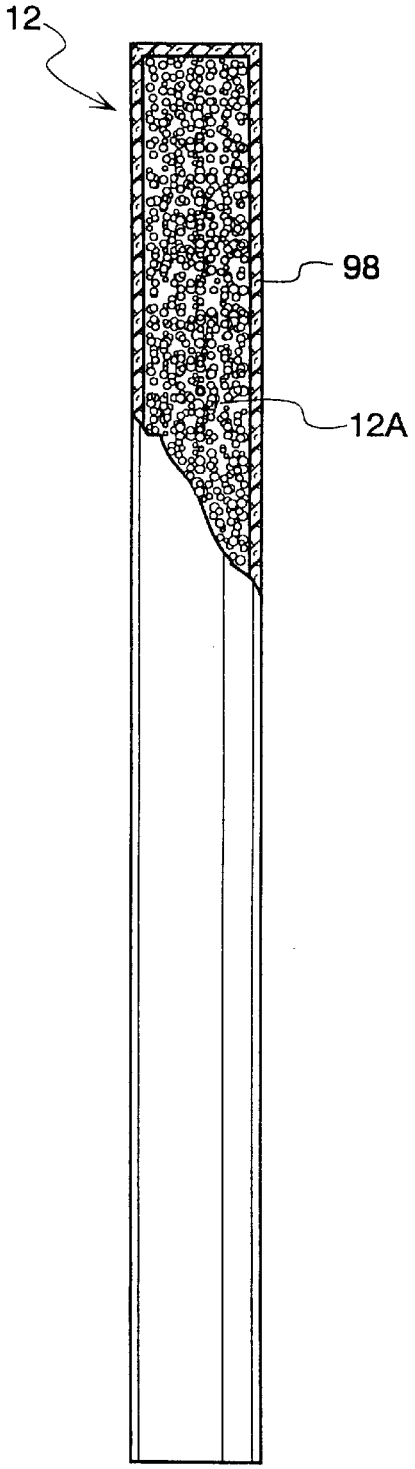
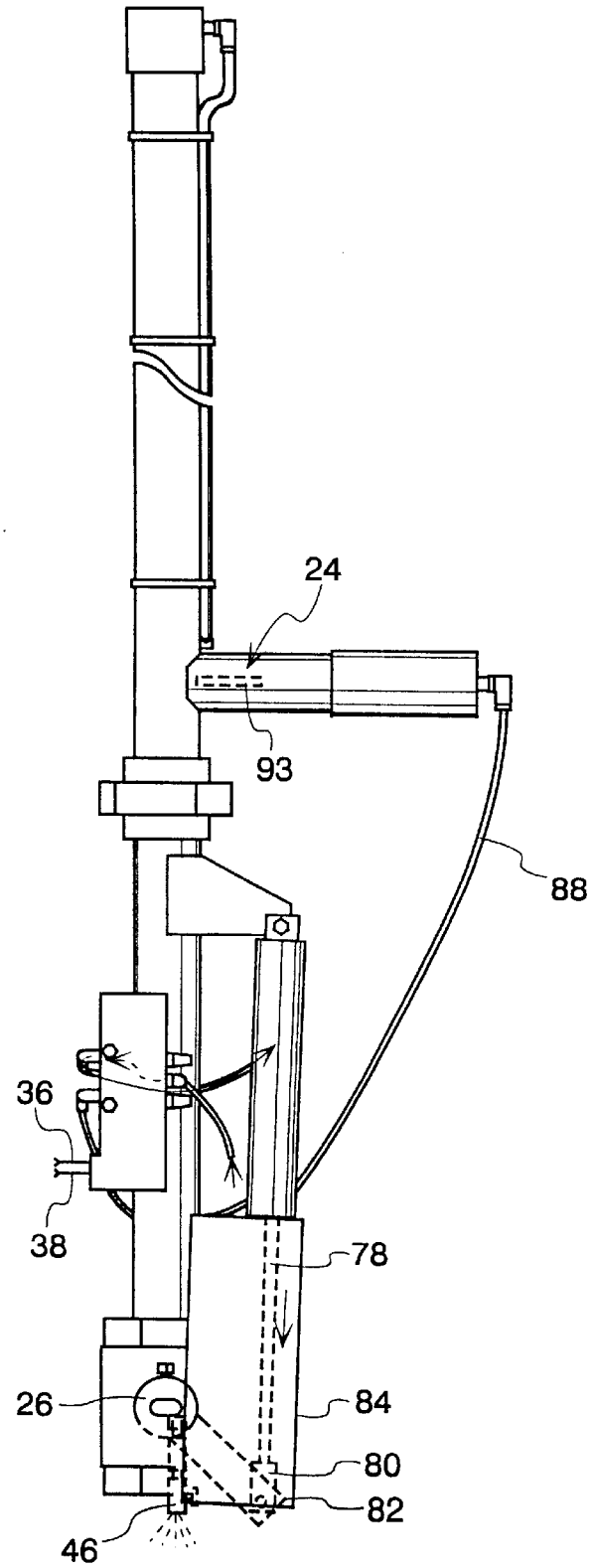
Fig. 4

CHEMICAL DISPENSING SYSTEM

FIELD OF THE INVENTION

The invention relates to an apparatus and method for dispensing chemicals into a well bore and, more particularly, to an apparatus and method for automatically dispensing solid chemical sticks into a well bore.

BACKGROUND OF THE INVENTION

Generally, early in a well's producing life, the differential pressure between the reservoir target zone and the bottom hole pressure (BHP) in the well bore is sufficient to allow the reservoir to give up the desired reservoir fluids. One problem in some oil and/or natural gas producing fields, and particularly with mature and/or depleted reservoirs, is that the wells tend to load-up with a fluid, such as salt water. Where the loading is to the point that the hydrostatic head is so great causing all production from the well to cease, such a fluid is termed a "kill" fluid. Typically, early in a well's life, the reservoir pressure is high and the well flows by its own energy so that the water is pushed out from the bore and produced with the oil and/or gas. However, as the reservoir pressure is depleted and fluid builds in the bore, the fluid weight can be so great as to exert sufficient pressure on the formation to prevent the desired rate of flow from the reservoir, such as gas flow that would otherwise aerate the liquid and cause the well to flow by lightening of the fluid gradient, to decrease the well's BHP.

When the well is in its latter stages of flowing life and the well is capable of producing only a portion of the desired fluids, or when the well dies and does not flow under its own power, it is known to use so-called artificial lift systems to maintain a reduced producing bottom hole pressure to improve flow of desired fluids from the low pressure reservoir. Artificial lift systems include the use of subsurface pumps which can pump loaded fluid from the well bore. Examples of such pumping systems include rod-drawn pumps and submerged centrifugal pumps. Gas lift is also used as a method of lifting fluid where relatively high pressure gas is used as the lifting medium. In one form called continuous flow, a continuous volume of high-pressure gas is introduced into the tubing string via downhole gas lift valves to aerate or lighten the fluid column until reduction of the bottom hole pressure will allow a sufficient differential across the sand face, causing the well to produce the desired rate of flow. In any event, installation and operation of these artificial lift systems for unloading well fluids can entail significant expenditures for both the surface and down hole equipment utilized and the energy required for their operation.

The economics for a well may make the use of such an artificial lift system for unloading well fluid cost-prohibitives, particularly for low capacity or marginal wells where some production continues despite accumulated water and which are in the early stages of fluid loading. Thus, for these types of wells, it is known to add foaming agents, such as a surfactant, to cause the water to foam which unloads the well in a relatively simple fashion. The surfactant comes in the form of soap sticks specifically formulated for unloading or de-liquefying well bores, with the soap sticks being manually dropped into the fluid in the bore at the well head by field personnel. The soap sticks dissolve in the water and greatly decrease the surface tension thereof, and, where the well is producing some gas, the addition of the surfactant causes the formation of large volumes of foam or gas bubbles in the fluid/surfactant solution which results in a much smaller fluid gradient for the column of the foamed fluid in the bore allowing it to be lifted therefrom by the flowing gas and/or oil from the reservoir.

It is common practice for field operators to drive from well to well and manually dispense the sticks into the well bores, preferably at prescribed time intervals as determined for the needs of particular wells in the field. Depending on the severity of the loading, this procedure may have to be repeated several times each month in order to maximize production from the well. Where the field contains a number of such wells that need to be unloaded, the effort required for an individual field operator to properly dispense the soap sticks is great. Moreover, employing additional people to dispense the sticks may be cost-prohibitive, particularly where the field contains a number of low capacity or very mature, depleted wells. Thus, there is a need to optimize production from wells loaded with fluid while reducing the costs associated with well site visits by field personnel for manually dispensing soap sticks into well bores.

Accordingly, automated prior art devices are known for dispensing soap sticks at predetermined times into well bores over which they are mounted. For example, U.S. Pat. No. 4,785,880 to Ashton and U.S. Pat. No. 5,188,178 to Noyes disclose use of a rotatable carousel including tubes or cylinders for holding the individual soap sticks until they are rotated over an opening in the bottom plate of the carousel which is aligned over a passageway leading to the well head. The '178 patent requires a separate motor with its drive shaft extending into the carousel for rotatively driving the carousel axle. The '880 patent teaches a complex mechanism utilizing a number of moving parts where rotation of the carousel occurs in a ratcheting fashion by way of upward movement of a rod in a slot formed in a tubular guide member. The dispensing mechanisms of both these patents are quite complex in requiring rotating carousels and the use of motors and the rod and guide for driving the carousels for rotation. Thus, there is a need for a mechanism which can automatically dispense chemicals, such as solid soap sticks into a well bore, and which is simpler in design and in operation than the automatic dispensing mechanisms of the prior art patents, as described above.

SUMMARY OF THE INVENTION

In accordance with the present invention, an apparatus for automatically dispensing chemical sticks into a well bore based on a predetermined condition, such as predetermined time intervals or a predetermined well condition, is provided which is an improvement over prior carousel-type devices described earlier. The present apparatus is much simpler and has substantially fewer moving parts, particularly with respect to the manner in which chemical sticks are fed from storage therein.

The dispensing apparatus herein includes an elongate receptacle for containing chemical sticks loaded therein. The receptacle has a longitudinal axis which extends in a first direction when the receptacle is in its operating position for dispensing sticks therefrom. Chemical sticks are stacked end-to-end along the receptacle longitudinal axis in a storage section of the receptacle. A lower receiving chamber of the receptacle can be positioned at the well head over the well bore. The lower receiving chamber receives the bottom stick from the stack in the storage section and automatically dispenses it based on the occurrence of a predetermined condition. A feeding mechanism is provided on the receptacle and feeds sticks from the storage section to the receiving chamber after dispensing of a stick from the chamber. Feeding and dispensing of sticks takes place with the receptacle in the operating position and the receptacle longitudinal axis extending in the first direction with the feeding mechanism operable to feed sticks for linear travel in the first direction from the storage section to the receiving chamber.

Preferably, the feeding mechanism is a holding device which engages the bottom stick in the stack in the storage section as the receiving chamber is dispensing the stick it contains therefrom. After dispensing, the holding device disengages from the bottom stick allowing the stick to fall as by gravity with at least the bottom stick being fed to and entering the receiving chamber.

Stacking the sticks in the storage section and the linear feeding of the stick from the receptacle storage section to the receiving chamber by gravity is a much simpler manner of storing and feeding sticks from storage than the prior stick storage and feeding systems. In the previously-described carousel devices, the carousel needs to be driven for rotation to rotate the sticks stored and carried thereby for feeding into a passageway leading to the well bore. The present linear feeding from storage significantly simplifies feeding of sticks to the receptacle receiving chamber of the dispensing apparatus herein and obviates the necessity for rotatably driving the storage mechanism for feeding of stored sticks thereby. The lower number of moving parts and reduced complexity of the present dispensing apparatus leads to enhanced performance in terms of the reliability of its operation, lowering the operating costs thereof as well as reducing the cost for manufacturing the dispensing apparatus herein.

The elongate receptacle can include a releasable hinge joint which can be released to allow a pivoting of a portion the receptacle open about the joint from the operating position to a loading position where the pivoted portion extends in a second direction different from the first direction for loading of sticks into the pivoted open receptacle.

In a preferred form, the apparatus includes an elongate tubular receptacle for containing chemical sticks loaded therein and for being attached above the well bore such as at the well head thereof. The receptacle includes an upper storage section in which a plurality of chemical sticks can be loaded. A releasable hinge on the tubular receptacle allows a portion of the receptacle to be pivoted about the releasable hinge joint for loading chemical sticks into the receptacle. A lower receiving chamber of the receptacle below the receptacle storage section receives at least one of the chemical sticks and dispenses it into the well bore. The chamber is either (1) open for being in communication with the well bore so that the chemical stick loaded in the receptacle and disposed in the chamber is dropped into the well bore with the sticks in the storage section prevented from entering the chamber or (2) closed for being blocked from communication with the well bore with the bottom stick in the storage section being allowed to drop into the chamber to load the empty chamber for dispensing the stick loaded therein into the well bore when the chamber is once again opened to the well bore. An operating mechanism opens and closes the chamber to the well and keeps the stick in the storage section when the chamber is open to the well and loads the chamber with one of the sticks when the chamber is closed to the well. Herein, when the phrases opened or closed to the well or well bore are utilized relative to the receptacle, and particularly the receiving chamber thereof, it is assumed that the master valve at the well head is opened so as to be able to provide the receptacle with communication to the well bore.

As previously mentioned, the above apparatus avoids the use of rotating parts such as the carrousels of the prior art and allows a well operator to simply stack a number of sticks in the tubular receptacle by pivoting it about the releasable hinge joint to a loading position and dropping the sticks into the receptacle until it is fully loaded and then pivoting the tubular receptacle back into its operating position and locking the hinge joint. Thus, with the storage section for the sticks being a vertical section of a tubular receptacle or pipe as opposed to a rotating carousel, the present apparatus provides for improved reliability by reducing the number of moving parts for the storage of chemical sticks which also reduces the cost in manufacturing the apparatus herein.

The chemical sticks can be soap sticks which are commercially available, typically in standard predetermined sizes. Preferably, the upper storage section is sized to contain a predetermined number of such standard size soap sticks and the hinge joint is adjacent the bottom of the upper storage section of the tubular receptacle so that, with the receptacle portion pivoted open about the hinge joint, the predetermined number of soap sticks can be slid into the storage section. The lower receiving chamber can be sized so as to contain a single chemical stick therein.

In one form, the operating mechanism is a pneumatically controlled actuating mechanism including a source of pressurized gas with the gas being a natural gas so that the gas source supplies the actuating mechanism with natural gas. The natural gas can be methane, or any other type of natural gas from a producing well bore.

The pneumatically controlled mechanism can include a solenoid valve supplied with the pressurized natural gas. The operating mechanism can include a controller to send an operating signal to the solenoid valve so that the valve regulates gas flow therethrough for opening or closing of the receiving chamber. The signal can be based on (1) a predetermined timing sequence for dispensing of the chemical stick loaded in the receiving chamber into the well bore at predetermined time intervals, or (2) a predetermined sensed well condition for dispensing of the chemical stick loaded in the receiving chamber into the well bore when the sensed well condition dictates the need for dispensing of the chemical stick. Automating the dispensing of the chemical sticks is a substantial improvement over the current procedure where a well operator has to visit the well site to manually drop sticks into the well bore. Particularly where the chemical sticks are dispensed based on well conditions and flow characteristics to optimize well production rates, the automated apparatus herein is a substantial improvement over the manual dispensing, where the demands placed on field personnel only allow the sticks to be dispensed on a periodic, happen-stance basis. Moreover, the present apparatus obviates the need for an operator to open the well head for dropping the sticks into the well bore which exposes the operator to undesirable hazards.

In one form, the operating mechanism includes a holding device operable to keep the chemical sticks in the upper storage section held in the receptacle with the chamber open to the well bore so that only the stick in the chamber is dropped into the well bore. The holding device can include a pin which is movable transverse to the elongate tubular receptacle between (1) an extended position with the pin engaging and holding the bottom stick in the stack of chemical sticks in the storage section to keep the stack of sticks in the storage section with the receiving chamber opened to the well bore, and (2) a retracted position with the pin disengaged from the bottom stick in the chemical stick stack in the storage section to allow the bottom stick of the stack to drop into the receiving chamber to load the chamber with a chemical stick with the receiving chamber closed to the well bore.

In a preferred form, the apparatus is provided in combination with soap sticks which includes a sheath around each stick, with the sheath being formed of a flexible, resilient material. With the holding pin in the extended position, the pin will pierce the sheath and project into the soap stick therein. The resilient sheath tightly engages the outer surfaces of the stick body and thus acts to keep the soap stick together therein. In this manner, the pin holding device will not cause the soap stick into which it is extended to break apart or crumble while it is holding the stack of sticks in the storage section.

In another aspect of the invention, a method for dispensing chemical sticks into a well bore is contemplated with the method including providing an elongate tubular receptacle having an upper storage section and a lower receiving chamber for being positioned above the well bore; loading a plurality of chemical sticks into the receptacle stacked end-to-end therein with at least one of the sticks in the receiving chamber and the remaining sticks in the storage section; holding the sticks in the storage section; opening the receiving chamber to be in communication with the well bore to dispense the at least one stick therein into the well bore; closing the receiving chamber to be blocked from communication with the well bore after dispensing of the at least one stick; and releasing the sticks in the storage section to allow the bottom stick therein to drop into the closed receiving chamber to load the receiving chamber with another stick for subsequently being dispensed into the well bore.

The tubular receptacle can be mounted in substantially vertical alignment over the well bore, and the receptacle can be provided with a releasable hinge joint for chemical sticks into the receptacle, including releasing the hinge joint and pivoting the tubular receptacle out from vertical alignment with the well bore.

Holding the sticks in the storage section can include extending a detent pin transversely of the tubular receptacle into engagement with the bottom stick in the storage section.

BRIEF DESCRIPTION OF THE DRAWINGS

FIG. 3 is a perspective view, partially in section, of a preferred chemical stick in accordance with the present invention showing the stick in the form of an elongate soap stick encased in a resilient tubular sheath;

FIG. 4 is a side elevational view similar to FIG. 2 showing in dashed lines a valve actuator closing a bottom receptacle valve and a blow-down valve on the receptacle opened to bleed pressure therefrom;

DETAILED DESCRIPTION OF THE PREFERRED EMBODIMENT

Figure 1:
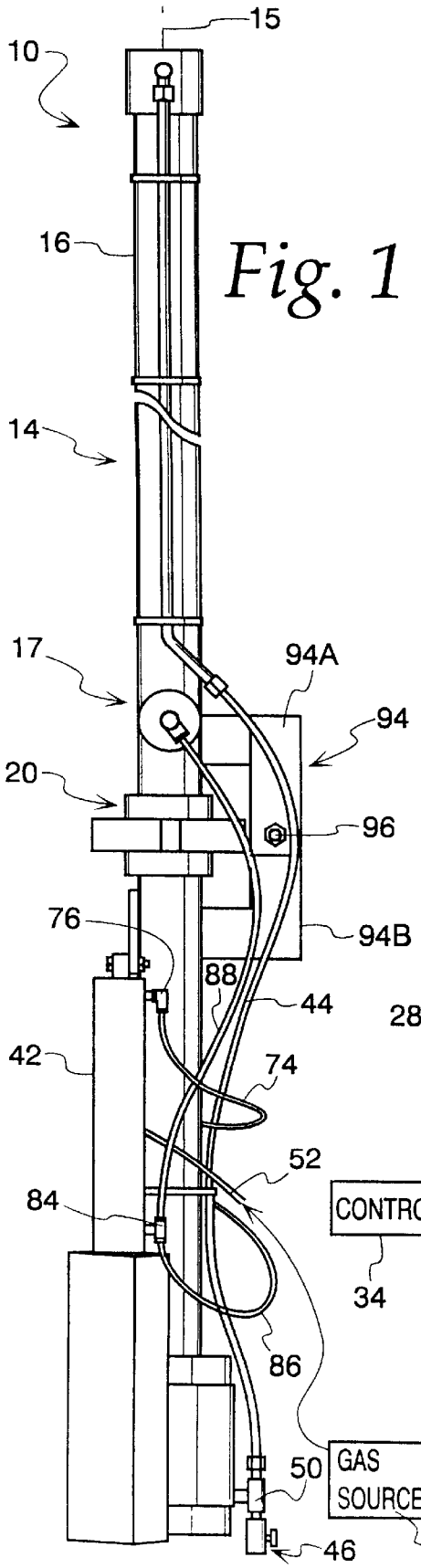
FIG. 1 is a front elevational view of an apparatus for dispensing chemical sticks into a well bore in accordance with the present invention and showing a tubular receptacle for receiving chemical sticks therein with the receptacle having an upper storage section and a lower receiving chamber.

In FIG. 1, an apparatus 10 for automatically dispensing chemical sticks 12, such as soap sticks, into a well bore, such as of an oil or gas producing well, is shown. The apparatus 10 herein is of very simple design and includes an elongate tubular receptacle 14 in which a plurality of the chemical sticks can be stacked in an end-to-end orientation with respect to each other, as can be seen in dashed lines in FIG. 6. The tubular receptacle 14 has a longitudinal axis 15 and includes an internal passageway 14*a* in which the sticks 12 are received stacked therein along the receptacle longitudinal axis 15 with the passageway including an upper storage section 16 and a lower receiving chamber 18 below the storage section 16 when the receptacle 14 is in its upstanding operating position. The receiving chamber 18 has a dispensing state where it is adapted to dispense sticks 12 therefrom when a predetermined condition occurs, as will be more fully discussed herein. A feeding mechanism 17 is provided for feeding sticks 12 from the storage section 16 to the receiving chamber 18 when the receiving chamber 18 is not dispensing sticks therefrom. When the receiving chamber is in its non-dispensing state, the feeding mechanism 17 is operable to allow at least the bottom stick 12 in the stack in the storage section 16 to drop into the receiving chamber 18 under the influence of gravity in a straight-line path in the receptacle 14 along the longitudinal axis 15 thereof. In this manner, the sticks 12 are fed for linear travel from the storage section 16 to the receiving chamber 18. Thus, there is no rotation required to feed sticks 12 for subsequent dispensing down into a well bore with the present apparatus 10 as in the previously-described carousel-type devices, where a mechanism is required for rotating the carousel carrying the stored sticks for feeding sticks from the storage carousel to dispense them into the well bore. The present apparatus 10 utilizes straight-line feeding of sticks 12 from storage via gravity feed and then into the well bore from receptacle 12 so as to minimize the number of moving parts and the complexity of the device over the prior carousel-type feeders.

Figure 5:
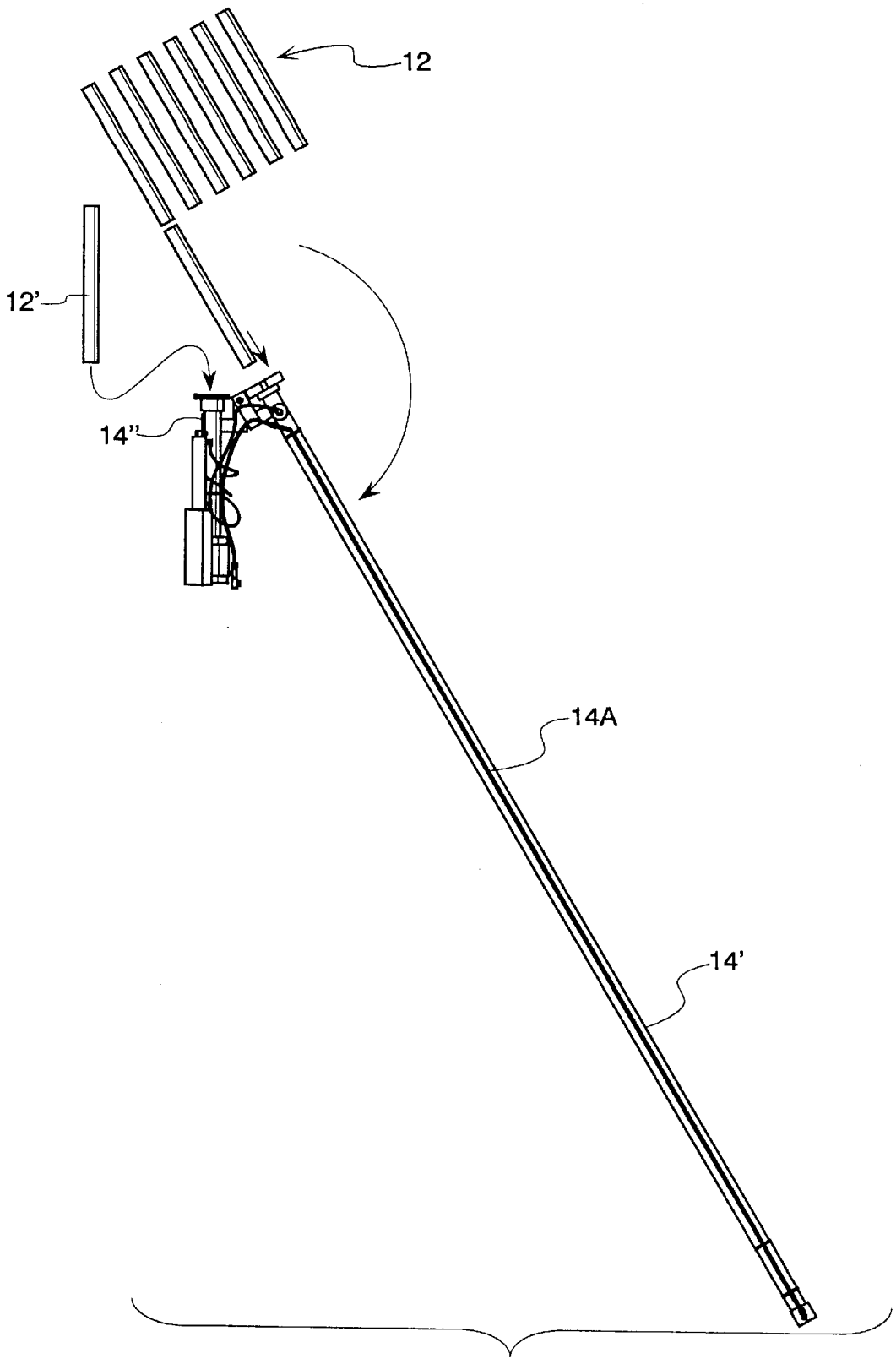
FIG. 5 is a side elevational view of the dispensing apparatus showing the tubular receptacle pivoted about a releasable hinge joint to an open, loading position for loading of a plurality of chemical sticks therein.

For loading the receptacle 14 with sticks 12, a releasable hinge joint, generally designated at 20, is provided along the length of the tubular receptacle 14 such as adjacent the bottom of the upper storage section 16 thereof to allow the joint 20 to be released for pivoting open a portion 14' of the receptacle 16 from the operating position of FIG. 1, where the portion 14' extends along the longitudinal axis in a first direction to the loading position, where the portion 14' is pivoted to extend in a second direction different from the first direction, as shown in FIG. 5. This allows the sticks 12 to be loaded into the storage section 16 of the tubular receptacle 12 with one of the sticks 12' being loaded into the receiving chamber 18. As previously mentioned, the apparatus 10 can be used to dispense soap sticks which are commercially available in standard sizes. In the illustrated embodiment, the tubular receptacle is designed so that the storage section 16 has a length sufficient to accommodate seven standard soap sticks therein with the receiving chamber adapted to receive a single soap stick 12' therein, although it will be recognized that the apparatus 10 can be modified from the depicted embodiment to accommodate different numbers of sticks therein.

The tubular receptacle 14 includes an operating mechanism therefor, generally designated at 22, and which includes the feeding mechanism 17 along with other features which will be described more fully herein. The operating mechanism controls the feeding of sticks 12 in the receptacle 14 to the receiving chamber 18 thereof and the dispensing of chemical sticks 12 from the tubular receptacle 14 and into the well bore. As previously mentioned, the apparatus 10 of the present invention is a relatively simple mechanism for automatically dispensing chemical sticks 12 into well bores in that the dispensing apparatus 10 utilizes an upstanding tubular receptacle 14 which can be in the form of a Schedule 80 steel material length of pipe, with the storage section 16 for the sticks 12 simply being the upper section of the pipe and the receiving chamber 18 being the section of pipe immediately below the storage section 16. In this manner, the feeding mechanism 17 is operable to feed sticks 12 from the storage section 16 to the receiving chamber 18 by gravity feed, as previously described. This obviates the need to provide for a driving mechanism such as in prior carousel devices for rotating the carousel and sticks carried thereby before they are dispensed therefrom, thus reducing the number of moving parts and expense in manufacture of the present apparatus 10 and also reducing the likelihood of experiencing mechanical failure and thus the operating cost for running the apparatus 10 herein.

The following is a more detailed description of the structure and operation of the preferred and illustrated form of the present dispensing apparatus 10. In the preferred form, the elongate receptacle 14 is a length of steel piping as mentioned earlier having joint 20 formed therealong so that with the receptacle 14 in operating position, it will generally have a continuous tubular form from top to bottom with the upper storage section 16 thereof in vertical alignment over the lower receiving chamber 18 thereof. With the joint 20 tightened to secure the section 16 and chamber 18 in vertical alignment, the receptacle 14 can be attached to a well head over a well bore in operating position. Thus, with the receptacle 14 in operating position and when the chemical stick 12*a* in the receiving chamber 18 is to be dispensed into the well bore, the remaining sticks 12 in the apparatus 10, and in particular the storage section 16 thereof, need to be maintained therein so as not to release more than the desired number of chemical sticks 12 into the bore. In this regard, the operating mechanism 22, and more particularly the feeding mechanism 17 thereof, includes a holding device 24, with the operating mechanism 22 further having a bottom receptacle valve 26 with both the holding device 24 and the receptacle valve 26 being actuated by an actuating mechanism 28 of the operating mechanism 22. The actuating mechanism 28 can include a pneumatic solenoid valve 30 which regulates the flow of pressurized gas from a source 32 of pressurized gas. Preferably the gas is a natural gas from a producing well of the field, such as methane gas. Alternatively, it is possible that wells in the field will be operating with a well head/annulus pressure below the pressure needed for the actuating mechanism 28 and specifically that needed to actuate the receptacle valve 26, as will be described hereinafter. In these instances, the source 32 could be obtained from off site for use with the dispensing apparatus 10, such as a nitrogen bottle.

Figure 2:
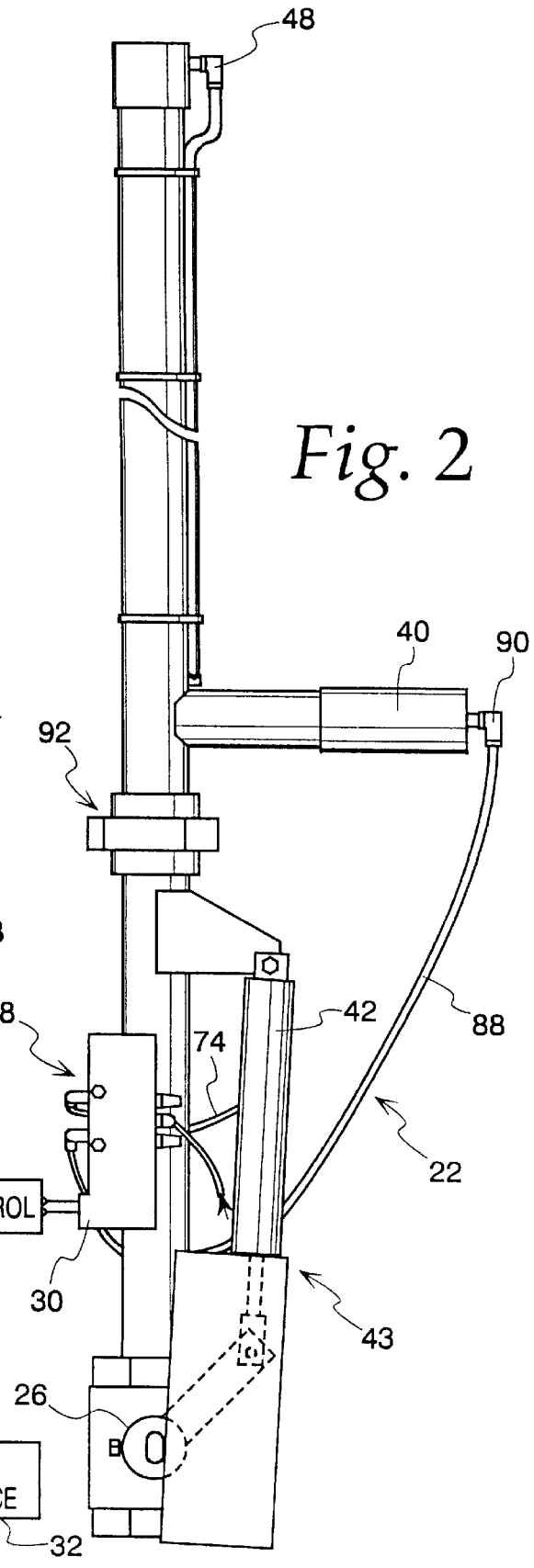
FIG. 2 is a side elevational view of the apparatus of FIG. 1 showing an operating mechanism for the apparatus, including a control for controlling dispensing of sticks from the apparatus.
Figure 7:
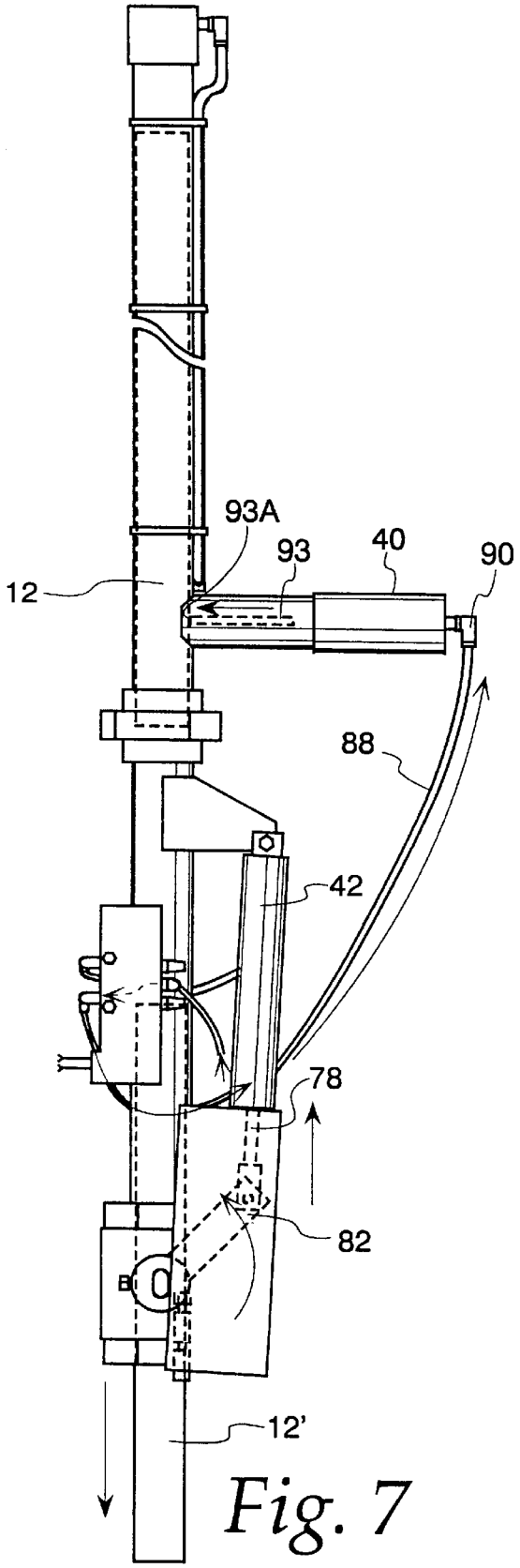
FIG. 7 is a side elevational view of the dispensing apparatus showing the bottom valve being opened by the valve actuator to allow the chemical stick in the chamber to be dispensed therefrom with the detent pin actuated to its extended position in the receptacle to hold the remaining sticks in the tubular receptacle.
Figure 8:
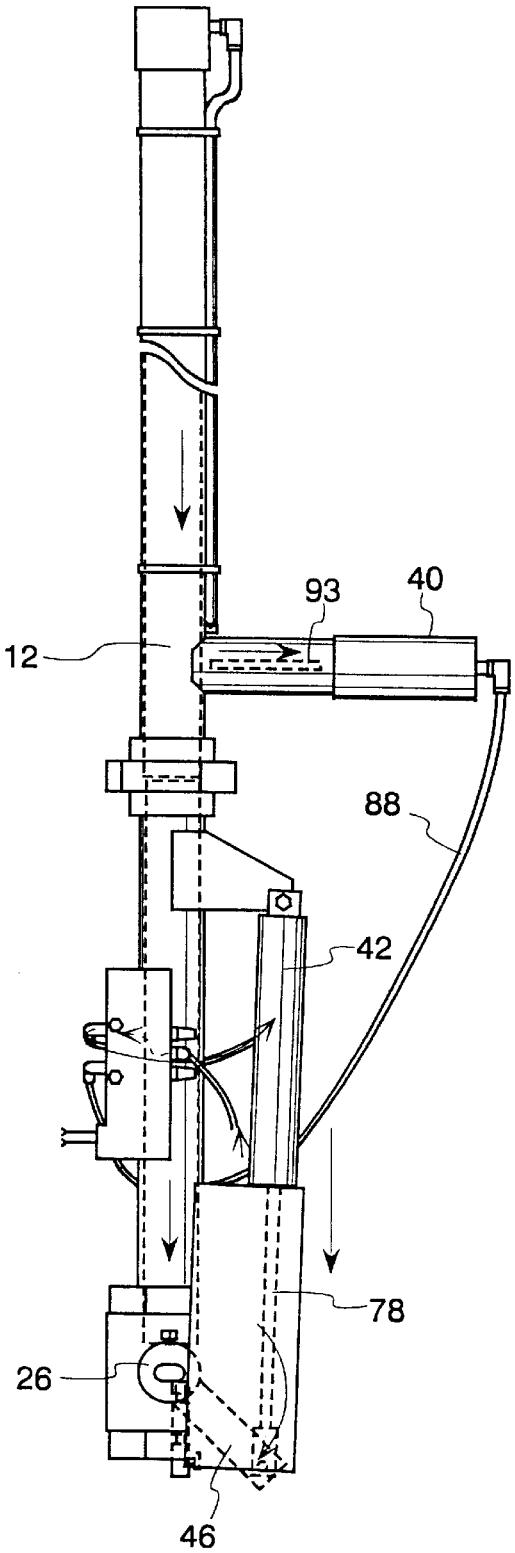
FIG. 8 is a side elevational view of the dispensing apparatus showing the chamber valve being closed by the valve actuator with the detent pin being retracted to allow the bottom stick in the storage section to fall into the closed lower chamber.

The pneumatic solenoid valve 30 can be controlled by operating signals received from control 34 on signal transmission lines 36 and 38 for starting a dispensing cycle, schematically illustrated in FIG. 2. The valve 30 regulates the flow of gas therethrough to pneumatic cylinder 40 for the holding device 24 and pneumatic cylinder 42, which is part of valve actuator 43 for the bottom receptacle valve 26. Thus, to dispense a chemical stick 12 into the well bore, the holding device 24 is actuated by the actuating mechanism 28 so as to maintain the sticks 12 in the storage section 16 therein while the actuating mechanism 28, and particularly the valve actuator 43, actuates the bottom receptacle valve 26 so as to allow the chemical stick 12*a* in the lower receiving chamber 18 to drop therefrom and into the well bore (FIG. 7). After dispensing of the chemical stick 12*a*, the actuating mechanism 28 is effective to close the bottom receptacle valve 26 and to cause the holding device 24 to allow the bottommost stick 12 in the storage section 16 to fall into the receiving chamber 18 (FIG. 8).

The control 34 can provide the operating signals to the solenoid valve 30 based on a predetermined condition such as a timing sequence so that sticks are dispensed into the well bore at predetermined time intervals or based on sensed well conditions, such as when a certain level of hydrostatic head is reached, or a certain well bore pressure or temperature or differential pressure or well bore flow rate occurs. Thus, for example, if the water level in the well bore becomes too high or the flow rate is too low, the control can send an operating signal to start a dispensing cycle which causes the dispensing apparatus 10 to drop a chemical stick into the bore to reduce the hydrostatic head of the fluid column built-up in the bore or, in other words, to unload or de-liquify the well. Control 34 can include a Digitrol timer for causing the stick to be dispensed at predetermined time intervals or can be hooked up to the Amoco Automation Well Head Control Package currently used to provide automatic readouts on production lines for various well conditions.

Thus, the dispensing apparatus 10 herein provides a significant advantage in that no longer will well operators have to travel between well sites for dropping soap sticks into well bores, and instead, the operators merely need to load the dispensing device 10 on a periodic basis after all the sticks loaded into a particular device 10 have been all dispensed into the bore. This should provide considerable savings in terms of reduction in miles driven and man-hours associated with actual visits to well site locations. When the dispensing device 10 has gone through the entire load of sticks 12 stacked therein, the operator simply opens the tubular receptacle 14 via the releasable hinge joint 20, as shown in FIG. 5. Because the passageway 14*a* of the tubular receptacle 14 has been in communication with the well bore during the dispensing operations, typically the passageway 14*a* will be under some pressure. Thus, prior to opening the tubular receptacle 14, the device 10 is de-pressurized via flexible pressure equalizing line 44 and blow down valve 46.

The pressure equalizing line 44 extends from the top of the tubular receptacle 14 to below the receiving chamber 18 and bottom receptacle valve 26. An elbow fitting 48 is attached to the top of the tubular receptacle 14 and to the passageway flexible line 44 and a T-fitting 50 is attached to the bottom of the apparatus 10 below the receptacle valve 26, with the flexible line 44 attached at one end of the T-fitting 50 and the blow down 46 attached at the other end of the T-fitting 50. The fitting 48 is effective to communicate the interior of the receptacle 14 at the top thereof with the line 44 and the T-fitting 50 is effective to communicate the interior of the apparatus 10 below the receptacle valve 26 with the line 44. In this manner, the flexible line 44 is effective to equalize pressure throughout the apparatus 10. When the operator wishes to open the apparatus 10 for filling it with chemical sticks 12, the blow down valve 46 is opened to de-pressurize the apparatus 10, as seen in FIG. 4. Of course, the loading of the sticks 12 into the apparatus 10 is done when the apparatus 10 is not in the process of dispensing a stick 12 therefrom between dispensing cycles thereof with the receptacle valve 26 being actuated closed. In addition, the holding device 24 is not actuated so as to hold any of the sticks 12 with pin 93 thereof retracted from receptacle passageway 14a to allow sticks 12 to be loaded therein.

Figure 9:
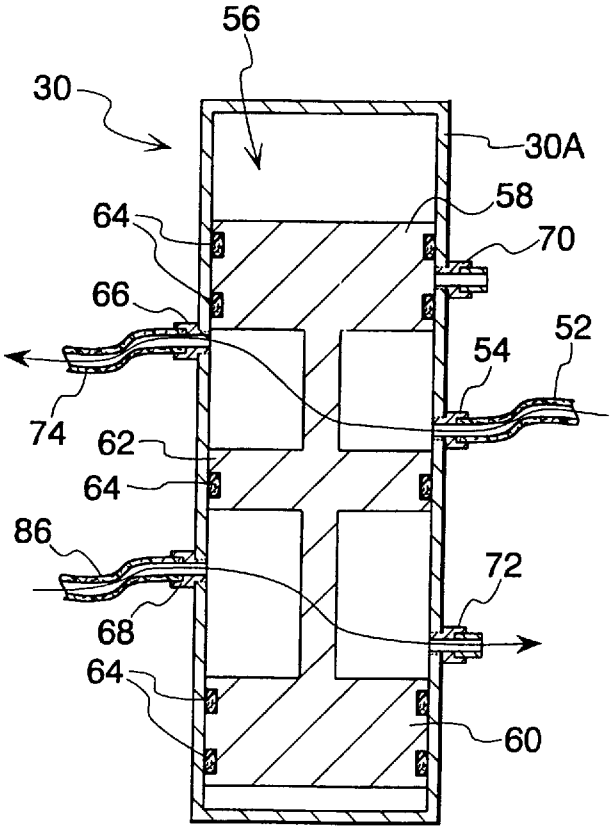
FIG. 9 is a sectional schematic view of a solenoid valve and the flow of pressurized gas therethrough for closing the receiving chamber valve and allowing the detent pin to retract, as seen in FIG. 8.

More specifically, when the dispensing apparatus 10 is not undergoing a dispensing cycle, the flow of pressurized air through the solenoid valve 30 will be as depicted in FIG. 9. Gas from gas source 32 travels from supply line 52 into the valve body 30*a* via supply port 54 thereon. For the non-dispensing mode, the control 34 signals the solenoid valve so that the valve member 56 is moved axially to the position in the valve body 30*a* shown in FIG. 9. The valve member 56 can be provided with two radial end seal members 58 and 60 and radial intermediate seal member 62 therebetween. Each of the radial seal members 58–62 is sized to be in close-fitting relation with the walls of the valve body 30*a*, with the seal members 58–62 having O-ring 64 seals mounted on their periphery so as to provide sealing engagement between the seal members 58–62 and the walls of the valve body 30*a*. In addition to supply port 54, the valve body 30*a* is provided with access ports 66 and 68 on either side, axially spaced from the supply port 54. Exhaust ports 70 and 72 are also provided, axially spaced on either side of the supply port 54 and also spaced from the access ports 66 and 68.

Thus, in the non-dispensing mode and between dispensing cycles, the control 34 signals the pneumatic valve 30 so that the valve member 56 therein is axially positioned in the valve body 30*a* as shown in FIG. 9. In this position, the supply gas will flow through supply port 54 with the intermediate seal 62 and the end seal 58 on either side of the port 54 so as to allow airflow from the port 54 to the access port 66 and out therefrom. In addition, the seal 58 is positioned in sealing relation over the exhaust port 70 so as to block the passage of gas therethrough, and the intermediate seal 62 is positioned between the supply port 54 and both the access port 68 and the exhaust port 72 so as to seal ports 68 and 72 from supply gas entering the valve body 30*a* through supply port 54.

The gas exiting valve body 30*a* from port 66 will travel through flexible gas line 74 connected to the port 66 at one end and at its other to the top of the pneumatic cylinder 42 via elbow fitting 76 so as to supply pressurized gas into the top of the interior of the pneumatic cylinder 42 causing the piston rod 78 therein to be pushed outwardly from the cylinder 42, down and away therefrom, as shown in FIG. 4. A 30 psig gas source 32 should be sufficient to operate pneumatic cylinder 42. The piston rod 78 can include a linkage plate 80 at its distal end exteriorly of the pneumatic cylinder 42, with the linkage plate connected to valve handle 82 of the bottom receptacle valve 26 for opening and closing of the receptacle valve with respective upward and downward strokes of the piston rod 78. The cylinder rod 78 and valve handle 82 can be substantially enclosed in housing guard 84, attached adjacent the bottom of the dispensing unit 10 below the pneumatic cylinder 42.

Downward movement of the piston rod 78 for closing of the valve 26 causes gas in the lower portion of the pneumatic cylinder 42 to be forced out from the bottom of the cylinder 42 via T-fitting 84. One end of the T-fitting is hooked up to flexible gas line 86 which is connected at its other end to the solenoid valve access port 58. The other end of the T-fitting 84 is connected to flexible gas line 88 which has its other end hooked up to right angle elbow fitting 90, attached to the radially outward end of the pneumatic cylinder 40 relative to the tubular receptacle 16. Thus, closing of the receptacle valve 26 causes air to flow from the bottom of the pneumatic cylinder 42 through the flexible line 86 into the valve body 30*a* through access port 68 and out therefrom via exhaust port 72 in communication with port 68, as shown in FIG. 9. With the solenoid valve 30 positioned as in FIG. 9 based on signals received from the control 34, the holding device 24 will also be inactive in that it will not be operating to hold any chemical sticks 12, as will be more fully described hereinafter. In this state, the holding device 24, which can take the form of pin 93 attached to the end of a piston rod (not shown) in the pneumatic cylinder 40, will be retracted out from the tubular receptacle passageway 14*a*, such as under the influence of a spring load which keeps the piston rod and attached pin 93 normally retracted. With the piston rod and attached pin 93 retracted, any gas in the radial outward portion of the pneumatic cylinder 40 will be bled therefrom through the fitting 90 into gas line 88, and through T-fitting 84 into gas line 86 and from there into the solenoid valve 30 for being exhausted from exhaust port 72 to atmosphere.

When the dispensing unit 10 no longer holds any chemical sticks 12 for being dispensed into the well bore, the operator can close the manual master valve on the well head and the can open the blow down valve 46 to bleed off any pressure developed in the tubular receptacle 16 of the dispensing unit 10 (FIG. 4). With the dispensing unit 10 de-pressurized, the operator next releases the releasable hinge joint 20, which includes a quick-union coupling 92 and a hinge 94 connected on either side of the quick-union coupling 92, to the tubular receptacle 14. The hinge 94 is provided with a pivotal connection between its upper portion 94*a* and lower portion 94*b* at pivot pin 96. Thus, to load chemical sticks into the receptacle 14 after it is de-pressurized by opening blow down valve 46, the operator unscrews the quick-union coupling 92 and the tubular receptacle 14 is pivoted open via hinge 94 (FIG. 5). When the dispensing apparatus or unit 10 is in operative position and attached over the well bore with the axis 15 of the receptacle extending substantially vertically, the portion 14' is pivoted open so that it extends in a direction offset from the vertical. In other words, where the dispensing unit 10 is attached to the well head upstanding thereover and in vertical alignment over the well bore, pivoting open of the tubular receptacle 14 pivots the portion 14' of the receptacle 14 above the quick-union coupling 92 out from vertical alignment with the well bore.

The sticks 12 are then slid into the receptacle passageway 14*a*, and, more particularly, the storage section 16 thereof, by sliding the sticks 12 one by one into the storage section 16 until it is filled with sticks 12. In this case, the storage section 16 is sized to receive seven standard-size soap sticks stacked in end-to-end fashion therein before it is filled with sticks 12. A single stick 12' can be put into the non-pivoted or vertical portion 14" of the receptacle 14 below the quick-union coupling 92 to load the lower receiving chamber 18 with a chemical stick 12'. Manifestly, it will be appreciated that the dispensing unit 10 herein can be sized so as to accommodate different numbers of chemical sticks in both the storage section 16 and receiving chamber 18 thereof.

With the tubular receptacle 16 fully loaded with chemical sticks 12, the operator pivots the portion 14' of the receptacle 14 pivoted open back onto the non-pivoted portion 14" and tightens the quick-union coupling 92. If desired, a stop (not shown) can be provided at the bottom of the pivoted portion of the receptacle 16 so as to positively prevent chemical sticks 12 from sliding out from the receptacle portion 14' as it is pivoted back onto the non-pivoted portion 14" of the receptacle 14. With the unit 10 loaded with sticks 12 and the quick-union coupling 92 tightened, and before the unit 10 undergoes a dispensing operation, the condition of the unit 10 loaded with chemical sticks will be as in FIG. 6, with the chemical sticks 12 stacked in an end-to-end orientation in the receptacle passageway 14*a* with one of the sticks 12*a* in the receiving chamber 18 and the remaining sticks in the storage section 16 and the detent pin 93 retracted from the passageway 14*a*.

Figure 10:
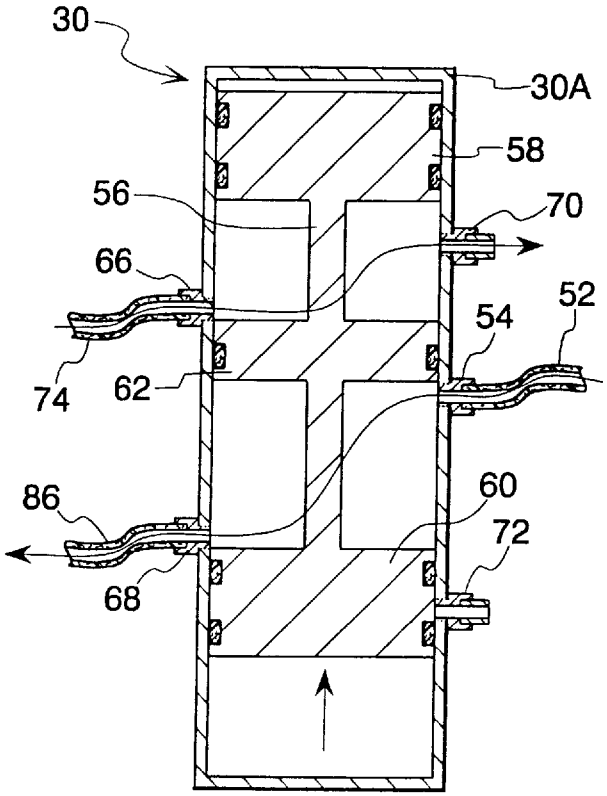
FIG. 10 is a sectional schematic view of the solenoid valve, similar to FIG. 9, where the gas flow through the valve is such as to open the receiving chamber valve and extend the detent pin into the receptacle as seen in FIG. 7.

Once the predetermined timing or well condition is reached, the control 34 is operable to start a dispensing cycle by signalling the solenoid valve 30 to cause the valve member 56 to move axially from its position of FIG. 9 to the position in FIG. 10. In this position, the intermediate seal 62 is moved to the other side of the supply port 54 and the end seal 60 is moved to cover the exhaust port 72 in sealing relation therewith so that the intermediate seal 62 and the end seal 60 straddle either side of the supply port 54 and allow the supply port 54 to communicate with the access port 68 and seal the supply port 54 from communicating with access port 66 and exhaust port 70. In addition, the end seal member 58 is moved from its sealing relation with the exhaust port 70 so that gas flowing through the line 74 into the valve body 30*a* through access port 66 can communicate and exit from the body 30*a* through exhaust 70 to atmosphere.

Figure 6:
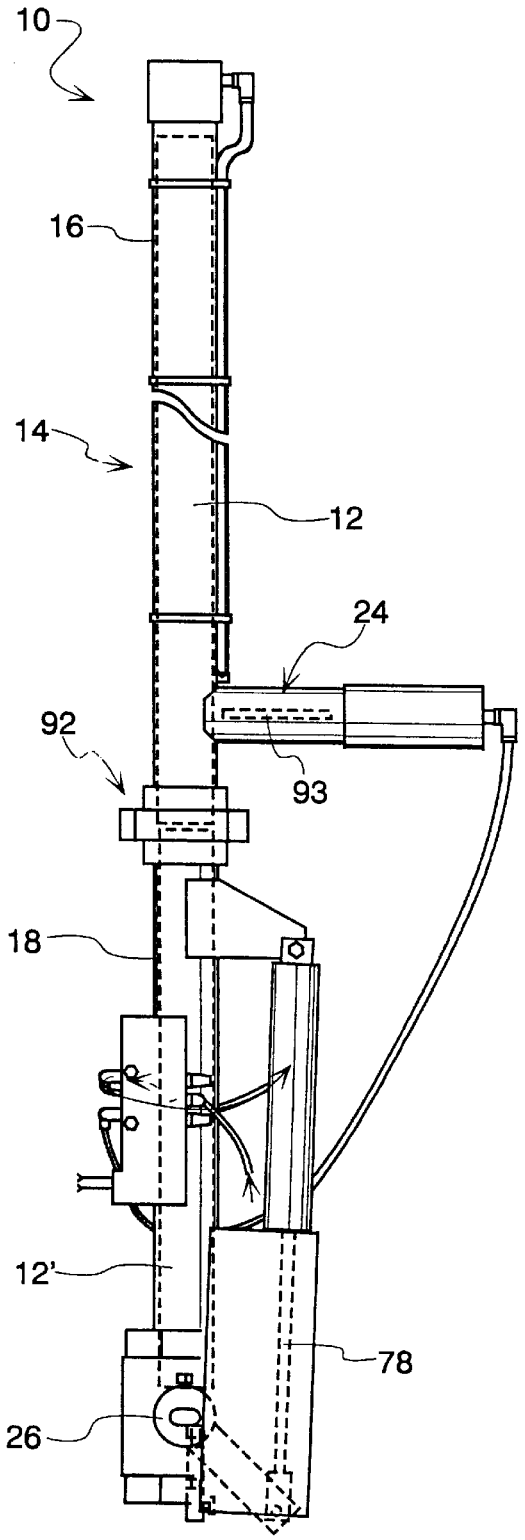
FIG. 6 is a side elevational view of the dispensing apparatus showing the tubular receptacle fully loaded with soap sticks and closed to its operating position with the valve actuator closing the bottom receptacle valve and a detent pin retracted from the receptacle.

The gas flow through the valve 30 as depicted in FIG. 10 will cause pressurized gas to be supplied through flexible line 86 to the bottom of the pneumatic cylinder 42 via T-fitting 84 so as to retract piston rod 78 into the cylinder 42, thus pivoting the valve handle 82 upward from its down, closed position of FIGS. 4 and 6 to open the bottom receptacle valve 26, as shown in FIG. 7. Gas flow will also continue from the other side of the T-fitting through the flexible gas line 88 into the radially outward end of the pneumatic cylinder 40 via elbow fitting 90 so as to extend detent pin 93 transversely relative to the receptacle longitudinal axis 15 into the receptacle passageway 14*a* and into engagement with the bottommost chemical stick 12 in the stack of sticks stored in the storage section 16, as shown in FIG. 8.

As the soap sticks 12 have a generally brittle consistency, they can be provided with an outer tightly fitting sheath 98 therearound which is preferably formed from a flexible, resilient material. With the sticks 12 placed in the resilient sheaths 98, the sheaths 98 will grab tightly onto the outer surfaces of the sticks 12. Thus, with the detent pin 93 extended into engagement with the bottommost stick 12 in the storage section 16, the inner end 93*a* of the pin 93 will pierce through the sheath 98 and into the body 12*a* of the stick 12 with the sheath 98 preventing the relatively brittle body material from falling apart so that the soap stick 12 is held together in the resilient sheath 98. In addition, the sheath 98 is preferably formed from a water-soluble material so that when the stick 12 is dispensed into the well bore, the sheath 98, along with the soap stick body 12*a*, will dissolve in the water built-up in the bore. It has been found that Aqua Clear, Inc. has a commercially-available sheath 98 which is effective to encase and grip tightly onto standard sizes of soap sticks 12 for the purposes described above.

With the detent pin 93 extended in its extended position and the pin 93 engaging and piercing through the stick sheath 98 into the stick body 12*a* to hold the bottom stick 12 in the storage section 16, the pin 93 is operable to keep the remaining sticks 12 in the storage section 16 while the receptacle valve 26 is being opened to release the stick 12' in the receiving chamber 18 down into the well bore therebelow, as illustrated in FIG. 7. After the stick 12' is dispensed, the control 34 signals the solenoid valve member 56 to move back to its original position of FIG. 9 to complete a dispensing cycle, such as after approximately 2–3 seconds, which gives the stick 12' sufficient time to fall from the dispensing unit 10 out from the receiving chamber 18 thereof. With the valve member 58 repositioned as in FIG. 9, the gas flow will be as previously described so as to cause the piston rod 78 to be extended for pivoting the valve handle 82 back down to close the receptacle valve 26 and to remove the pressure from the pneumatic cylinder 40 to allow the detent pin 93 to retract out from the receptacle passageway 14*a* under the influence of its spring load with pressure being bled from the cylinder 40 through the gas line 88, the T-fitting 84, gas line 86, and through the body 30*a* of solenoid valve 30 and out to atmosphere from exhaust port 72 thereof. Similarly, extending the piston rod 78 out from the pneumatic cylinder 42 causes gas in the bottom of the cylinder 42 to be pushed out from the T-fitting 84 into gas line 86 and through valve body 30*a* and out to atmosphere from exhaust port 72. Retracting of the detent pin 93 releases the bottommost stick in the storage section 16 of the tubular receptacle 14 so as to allow it to drop into the receiving chamber 18, which is now closed from the well bore by closed valve 26. The above-described dispensing cycle is repeated as often as is necessary based on either the predetermined timing sequence or well condition, as previously described.

Figure 11:
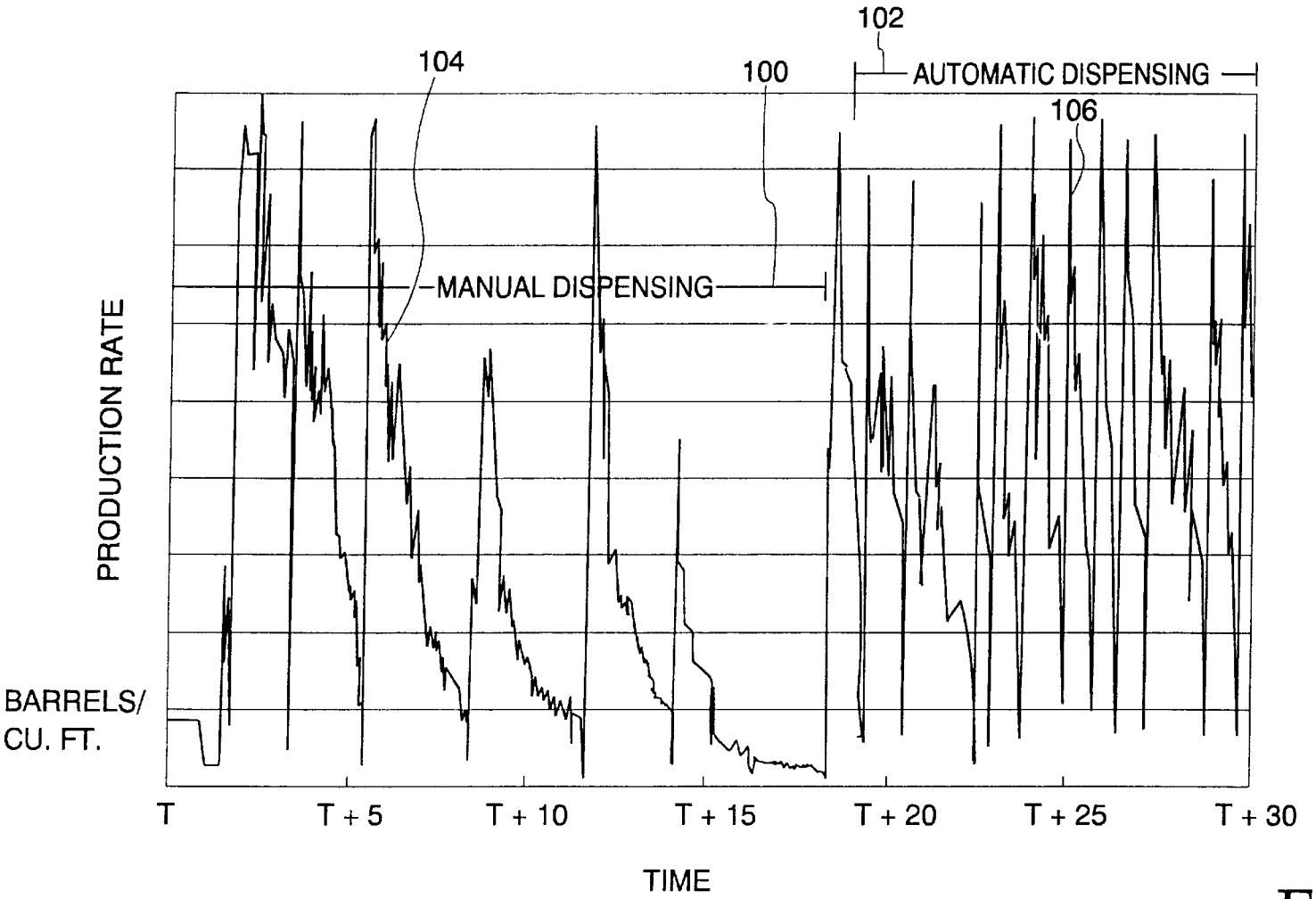
FIG. 11 is a graph showing production rates from a well bore using both manual dispensing of soap sticks and the automatic dispensing apparatus in accordance with the present invention.

The graph of FIG. 11 depicts the increased production achieved with the use of the automatic dispensing unit 10 described herein on a particular well. The line 100 is to the section of the graph indicating the level of production achieved when dispensing soap sticks into the well bore manually, whereas the line 102 is to the section of the graph indicating the production level achieved utilizing the dispensing unit 10 herein on the same well where dispensing can occur more frequently or as necessary such as based on predetermined time intervals or well conditions, as previously described. As can be seen by graph production line 104 for the manual dispensing section 100 and graph production line 106 for the automatic dispensing section 102 in FIG. 11, the disparity in production rates can be fairly significant, making the purchase and use of the dispensing unit 10 herein highly beneficial from an economic standpoint. As well operators are continually being pushed to operate more and more wells in a field or in multiple fields, the relatively simply designed dispensing unit 10 herein is a reliable and cost-effective alternative to the manual dispensing of soap sticks currently employed.

While there have been illustrated and described particular embodiments of the present invention, it will be appreciated that numerous changes and modifications will occur to those skilled in the art, and it is intended in the appended claims to cover all those changes and modifications which fall within the true spirit and scope of the present invention.

We claim:

1. An apparatus for dispensing chemical sticks into a well bore, the dispensing apparatus comprising:

an elongate receptacle for containing chemical sticks loaded therein and having a longitudinal axis, the receptacle having an operating position for dispensing chemical sticks therefrom with the receptacle longitudinal axis extending in a first direction;

an upper storage section of the receptacle in which a plurality of chemical sticks can be stacked end-to-end along the receptacle longitudinal axis;

a lower receiving chamber of the receptacle for being positioned above the well bore and receiving the bottom chemical stick from the stack of sticks in the receptacle storage section and automatically dispensing it from the receptacle based on the occurrence of a predetermined condition; and a feeding mechanism which feeds sticks from the upper storage section to the lower receiving chamber after the lower receiving chamber has dispensed a stick therefrom, the feeding mechanism being operable when the receptacle is in its operating position to feed sticks for linear travel in the first direction along the receptacle longitudinal axis from the storage section to the receiving chamber.

2. The dispensing apparatus of claim 1 wherein the feeding mechanism is a holding device which engages the bottom stick in the storage section when the receiving chamber is dispensing a stick therefrom and disengages from the bottom stick after the stick has been dispensed from the chamber to allow the stack of sticks to fall under the influence of gravity with at least the bottom stick entering the receiving chamber.

3. The dispensing apparatus of claim 1 wherein the elongate receptacle includes a releasable hinge joint which when released allows a portion of the receptacle to be pivoted about the joint from the operating dispensing position to a loading position with the pivoted portion extending in a second direction different from the first direction for loading of chemical sticks into the pivoted open receptacle.

4. The dispensing apparatus of claim 1 including an operating mechanism for controlling the dispensing of sticks from the receiving chamber and the feeding of sticks thereto by the feeding mechanism, and a controller of the operating mechanism which controls the dispensing and feeding operations based on the predetermined condition wherein the predetermined condition is either a predetermined timing sequence or a predetermined well condition.

5. An apparatus for dispensing chemical sticks into a well bore, the dispensing apparatus comprising:

an elongate tubular receptacle for containing chemical sticks loaded therein and for being attached above the well bore;

an upper storage section of the receptacle in which a plurality of chemical sticks can be loaded;

a releasable hinge joint on the tubular receptacle to allow a portion of the receptacle to be pivoted about the joint for loading chemical sticks into the receptacle;

a lower receiving chamber of the receptacle below the storage section for receiving at least one of the chemical sticks and dispensing the stick into the well bore, the chamber being one of (1) opened for being in communication with the well bore so that one of the chemical sticks loaded in the receptacle and disposed in the chamber is dropped into the well bore with the sticks in the storage section prevented from entering the chamber, and (2) closed for being blocked from communication with the well bore with the bottom stick in the storage section being allowed to drop into the chamber to load the empty chamber for dispensing the stick loaded therein into the well bore when the chamber is opened to the well bore; and an operating mechanism for opening and closing the chamber to the well bore and keeping the sticks in the storage section with the chamber open to the well bore and loading the chamber with one of the sticks with the chamber closed to the well bore.

6. The dispensing apparatus of claim 5 wherein the chemical sticks have a predetermined length and the upper storage section is sized to contain a predetermined number of chemical sticks and the hinge joint is adjacent the bottom of the upper storage section of the tubular receptacle so that with the receptacle portion pivoted open about the hinge joint, the predetermined number of chemical sticks can be slid into the storage section.

7. The dispensing apparatus of claim 5 wherein the chemical sticks have a predetermined length and the lower receiving chamber is sized to contain a single chemical stick.

8. The dispensing apparatus of claim 5 wherein the operating mechanism includes a pneumatically controlled actuating mechanism and a source of pressurized gas with the gas being a natural gas so that the gas source supplies the pneumatically controlled mechanism with natural gas.

9. The dispensing apparatus of claim 8 wherein the natural gas is methane.

10. The dispensing apparatus of claim 8 wherein the pneumatically controlled actuating mechanism includes a solenoid valve supplied with pressurized natural gas, and the operating mechanism further includes a controller to send an operating signal to the solenoid valve so that the valve regulates gas flow therethrough for opening or closing of the chamber with the signal being based on one of (1) a predetermined timing sequence for dispensing of the chemical stick loaded in the receiving chamber into the well bore at predetermined time intervals, and (2) a predetermined sensed well condition for dispensing of the chemical stick loaded in the receiving chamber into the well bore when the sensed well condition dictates the need for dispensing of the chemical stick.

11. The dispensing apparatus of claim 5 wherein the operating mechanism includes a holding device operable to keep the chemical sticks in the upper storage section held in the receptacle with the chamber opened to the well bore so that only the stick in the chamber is dropped into the well bore.

12. The dispensing apparatus of claim 11 wherein the holding device includes a pin which is movable transverse to the elongate tubular receptacle between (1) an extended position with the pin engaging and holding the bottom stick in the stack of chemical sticks in the storage section to keep the stack of sticks in the storage section with the receiving chamber opened to the well bore, and (2) a retracted position with the pin disengaged from the bottom stick in the chemical stick stack in the storage section to allow the bottom stick to drop into the receiving chamber to load the chamber with a chemical stick with the receiving chamber closed to the well bore.

13. The dispensing apparatus of claim 12 in combination with the chemical sticks wherein the sticks are soap sticks and include a sheath around each stick with the sheath being formed of a flexible resilient material, and with the holding pin in the extended position the pin pierces the sheath and projects into the soap stick therein with the sheath keeping the soap stick together therein.

14. The dispensing apparatus of claim 5 wherein the operating mechanism includes a bottom receptacle valve between the receiving chamber and the well bore, and a valve actuator for opening the receptacle valve for opening the receiving chamber to the well bore and closing the receptacle valve for closing the receiving chamber to the well bore.

15. An apparatus for dispensing a solid chemical stick into a well bore, the dispensing apparatus comprising:

an elongate receptacle for containing chemical sticks therein and having a longitudinal axis;

an upper storage section of the receptacle accommodating a plurality of chemical sticks stacked end-to-end along the receptacle longitudinal axis;

a lower receiving chamber of the receptacle for being positioned above the well bore and receiving the bottom chemical stick from the stack of sticks in the receptacle storage section and having a first state wherein the chamber is opened for being in communication with the well bore to allow the stick therein to be dispensed into the well bore and a second state wherein the chamber is closed for being blocked from communication with the well bore to prevent the stick therein from being dispensed into the well bore;

a holding device operable to keep the chemical sticks in the receptacle storage section held in the receptacle with the chamber in its first state so that only the stick in the chamber is dispensed into the well bore; and an actuating mechanism for the holding device and changing the states of the chamber between its first and second states wherein with the chamber actuated to its first state the actuating mechanism actuates the holding device to keep the remaining sticks in the receptacle and with the chamber actuated to its second state the actuating mechanism actuates the holding device to allow the bottom chemical stick from the stack of remaining sticks in the storage section to be loaded into the receiving chamber.

16. The dispensing apparatus of claim 15 wherein the receptacle includes a releasable hinge joint to allow the portion of the receptacle to be pivoted about the hinge joint to open the receptacle for loading of chemical sticks therein.

17. The dispensing apparatus of claim 15 including a receptacle valve between the receiving chamber and well bore, and the actuating mechanism includes a valve actuator for opening the receptacle valve with the receiving chamber in its first state and closing the receptacle valve with the receiving chamber in its second state.

18. The dispensing apparatus of claim 15 wherein the holding device includes an pin which is movable by the actuating mechanism transverse to the receptacle longitudinal axis between (1) an extended position with the pin engaging and holding the bottom stick in the stack of chemical sticks in the storage section to keep the stack of sticks in the storage section with the receiving chamber in its first state, and (2) a retracted position with the pin disengaged from the bottom stick in the chemical stick stack in the storage section to allow the bottom stick to drop into the receiving chamber with the receiving chamber in its second state.

19. The dispensing apparatus of claim 15 including a controller for providing the actuating mechanism with an operating signal based on one of (1) a predetermined timing sequence for dispensing of the chemical stick in the receiving chamber into the well bore at predetermined time intervals, and (2) a predetermined sensed well condition for dispensing of the chemical stick in the receiving chamber into the well bore when the sensed well condition dictates the need for dispensing of the chemical stick.

20. The dispensing apparatus of claim 19 wherein the actuating mechanism includes a pneumatic solenoid valve which regulates the flow of pressurized gas therethrough based on the operating signal from the controller.

21. A method for dispensing chemical sticks into a well bore, the method comprising:

providing an elongate tubular receptacle having an upper storage section and a lower receiving chamber for being positioned above the well bore;

loading a plurality of chemical sticks into the receptacle stacked end-to-end therein with the at least one of the sticks in the receiving chamber and the remaining sticks in the storage section;

holding the sticks in the storage section;

opening the receiving chamber to be in communication with the well bore to dispense the at least one stick therein into the well bore;

closing the receiving chamber to be blocked from communication with the well bore after dispensing of the at least one stick; and releasing the sticks in the storage section to allow the bottom stick therein to drop into the closed receiving chamber to load the receiving chamber with another stick for subsequently being dispensed into the well bore.

22. The method of claim 21 wherein the tubular receptacle is mounted in substantially vertical alignment over the well bore, and the receptacle is provided with a releasable hinge joint and loading of the chemical sticks into the receptacle includes releasing the hinge joint and pivoting a portion of the tubular receptacle out from vertical alignment with the well bore.

23. The method of claim 21 wherein the sticks are held in the storage section by extending a detent pin transversely of the tubular receptacle into engagement with the bottom stick in the storage section.

* * * * *